US007314527B1

(12) United States Patent
Reder et al.

(10) Patent No.: US 7,314,527 B1
(45) Date of Patent: Jan. 1, 2008

(54) REACTOR SYSTEM

(75) Inventors: Steven E. Reder, Boring, OR (US); Preston E. Pillow, Sandy, OR (US)

(73) Assignee: LSI Logic Corporation, Milpitas, CA (US)

( * ) Notice: Subject to any disclaimer, the term of this patent is extended or adjusted under 35 U.S.C. 154(b) by 1352 days.

(21) Appl. No.: 10/012,821

(22) Filed: Dec. 10, 2001

(51) Int. Cl.

| | |
|---|---|
| ***C23C 16/40*** | (2006.01) |
| ***C23C 16/448*** | (2006.01) |
| ***C23C 16/453*** | (2006.01) |
| ***C23F 1/00*** | (2006.01) |
| ***H01L 21/306*** | (2006.01) |

(52) U.S. Cl. ..... 118/715; 156/345.33

(58) Field of Classification Search ..... 118/715, 118/728, 50; 156/345.29, 345.33, 345.34, 156/345.35; 285/51

See application file for complete search history.

(56) References Cited

U.S. PATENT DOCUMENTS

| | | | | |
|---|---|---|---|---|
| 4,797,087 | A * | 1/1989 | Gitman | 431/10 |
| 4,954,076 | A * | 9/1990 | Fioravanti et al. | 431/116 |
| 5,082,517 | A * | 1/1992 | Moslehi | 156/345.26 |
| 5,283,985 | A * | 2/1994 | Browning | 451/38 |
| 5,292,246 | A * | 3/1994 | Gateau et al. | 431/328 |
| 5,423,942 | A * | 6/1995 | Robbins et al. | 216/67 |
| 5,526,984 | A * | 6/1996 | Foster et al. | 239/423 |
| 5,714,735 | A * | 2/1998 | Offer | 219/136 |
| 5,882,184 | A * | 3/1999 | Feldermann | 431/9 |
| 6,139,311 | A * | 10/2000 | Bowman et al. | 431/278 |
| 6,176,702 | B1 * | 1/2001 | Mohr et al. | 431/186 |

FOREIGN PATENT DOCUMENTS

SU 1763802 A1 * 9/1992

OTHER PUBLICATIONS http://lionreference.chadwyck.com/mwd/fulltext?action=nextprev&id=257591&file=../session/1077545264_26013.*

* cited by examiner

*Primary Examiner*—Rudy Zervigon
(74) *Attorney, Agent, or Firm*—Luedeka, Neely & Graham, P.C.

(57) ABSTRACT

A gas delivery system for delivering a gas to a reactor. The reactor has a reactor chamber, a gas inlet port, and a gas exhaust port. The gas delivery system included a torch chamber having an outer wall extending along a first axis. A torch injector extends into the torch chamber at a first end of the torch chamber. The torch injector includes at least one gas intake port for receiving at least one gas and a gas injector section for expelling the at least one gas into the torch chamber. A gas outlet section is disposed at a second end of the torch chamber. The gas outlet section includes a first tubing member disposed along a second axis and a gas outlet port connected to the first tubing member. The gas outlet port of the gas outlet section engages the gas inlet port of the reactor. The torch chamber, the torch injector, and the gas outlet section of the gas delivery system are formed into a unitized structure with no resealable connections between them.

19 Claims, 2 Drawing Sheets

REACTOR SYSTEM

FIELD

This invention relates to the field of integrated circuit processing. More particularly, this invention relates to gas delivery systems for delivering a gas to a reactor.

BACKGROUND

There is continual pressure for integrated circuits to be increasingly faster and increasingly more powerful. Both of these objectives tend to be influenced by the size of the integrated circuits. By fabricating smaller integrated circuits, electrical pathways are shorter and more devices are formed within a given space, which tends to result in a faster, more powerful integrated circuit.

However, as integrated circuits become smaller, the devices within integrated circuits also become smaller. As the various layers and structures become thinner, it tends to become increasingly important to control the formation of the layers and structures. Particles or other contaminants can adversely affect the formation of the layers and structures within the integrated circuit and therefore negatively impact device performance. Therefore, it is important to process the integrated circuits in the cleanest, most contaminant free environment as possible.

Many of the integrated circuit layers and structures are formed in closed processing systems. For instance, silicon dioxide layers which are often used as dielectric layers may be grown in reactor systems. The reactor systems include a gas delivery system and a reactor, such as a tube furnace. Each external connection between the gas delivery system and the reactor is a potential source of contamination. Conditions such as high gas temperatures or potentially corrosive gases may cause the degradation of materials within these connections. In addition to the degraded materials contaminating the gas delivery system, other contaminants from the ambient environment may enter the system through the connections as some of the materials continue to weaken.

Thus, there is a need for a gas delivery system which reduces the risk of contaminants entering into or escaping from the reactor system.

SUMMARY

The above and other needs are met by a gas delivery system for delivering a gas to a reactor. The reactor has a reactor chamber, a gas inlet port, and a gas exhaust port. The gas delivery system includes a torch chamber having an outer wall extending along a first axis. A torch injector extends into the torch chamber at a first end of the torch chamber. The torch injector includes at least one gas intake port for receiving at least one gas and a gas injector section for expelling the at least one gas into the torch chamber. A gas outlet section is disposed at a second end of the torch chamber. The gas outlet section includes a first tubing member disposed along a second axis and a gas outlet port connected to the first tubing member. The gas outlet port of the gas outlet section engages the gas inlet port of the reactor. The torch chamber, torch injector, and the gas outlet section of the gas delivery system are formed into a unitized structure with no resealable connections between them.

As used herein, the word "unitized" refers to a structure that does not have joints that are more susceptible to gas permeability than the material from which the structure itself is fashioned. The word is further restricted to structures that cannot be further broken apart without fracturing or otherwise cutting the structure. In other words, the structure, although possibly formed of sections having individual designations and functions, is not composed of separate parts, but is formed into a single piece. For example, a structure that has been formed of different parts that are welded together is a unitized structure, as is also a structure that has been molded as a single piece. A structure that is united by fittings that are designed to be taken apart and then put back together is not a unitized structure.

As used herein, the word "resealable" refers to a type of connection that is designed to be repeatedly made and broken, such as a ball and socket fitting, an o-ring fitting, or any one of a number of other such breakable and remakeable fittings.

At least one gas enters the gas delivery system through the gas intake port of the torch injector, flows through the torch injector and is expelled into the torch chamber. The gas exits the torch chamber through the first tubing member of the gas outlet section and the gas outlet port of the gas outlet section. The gas enters the reactor chamber through the gas inlet port from the gas outlet port, and leaves the reactor chamber through the gas exhaust port.

Thus, by forming a unitized gas delivery system with an integrated torch injector, torch chamber, and gas outlet section, only one external connection is required between the gas delivery system and the reactor. By reducing the number of external connections, the possibility of external contaminants or impurities entering the gas delivery system is diminished. Since any external connection in a gas delivery system is subject to degradation, the external connection point is a potential inlet for ambient atmospheric leaks and contamination. By having only one external connection, the gas delivery system of the present invention reduces the potential inlets for contamination, thus preferably providing a cleaner and more contamination free environment in which to process integrated circuits.

In various preferred embodiments of the invention, the gas outlet port is a socket fitting and the gas inlet port is a ball fitting. The gas outlet port most preferably includes a gas insertion nozzle for directing a gas flow from the gas outlet section of the unitized torch chamber into the gas inlet port of the reactor. Preferably, the gas insertion nozzle is a unitized structure with the gas outlet port.

In a most preferred embodiment, the torch chamber comprises two gas intake ports for receiving hydrogen gas and oxygen gas, which combine in the torch chamber to produce steam. In this embodiment the reactor is most preferably designed to form an oxide layer on the substrates within the reactor. However, it is appreciated that other gases could also be delivered through the gas intake ports, and that a different number of gas intake ports may be desirable, depending upon the purpose of the reactor system. For example, gases such as nitrogen and argon may be used as purge gases, and the system may also use anhydrous hydrochloric gas, nitric oxide, and nitrous oxide. Thus, the example as described herein is a preferred embodiment, but the invention is not to be unduly limited to the specific gases or number of gas intake ports as recited in the examples herein.

Preferably, the gas outlet port and gas inlet port comprise a ground glass joint with an o-ring seal disposed between the gas inlet port and the gas outlet port. The gas delivery system is most preferably made of glass. The first tubing member preferably has two ninety degree bends. In one embodiment, the torch injector comprises a substantially straight tubing section extending along an axis that is substantially parallel to the first axis of the torch chamber. In an alternate embodiment, the torch injector comprises a spiral tubing section extending along an axis that is substantially parallel to the first axis of the torch chamber.

As used herein, the word "glass" refers to any one oxide or any combination of more than one oxide, including oxides that contain other materials, such as silicates, boro silicates, boro phospho silicates, aluminum oxides, and other materials that reasonably fall within the glassy oxide group of materials.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
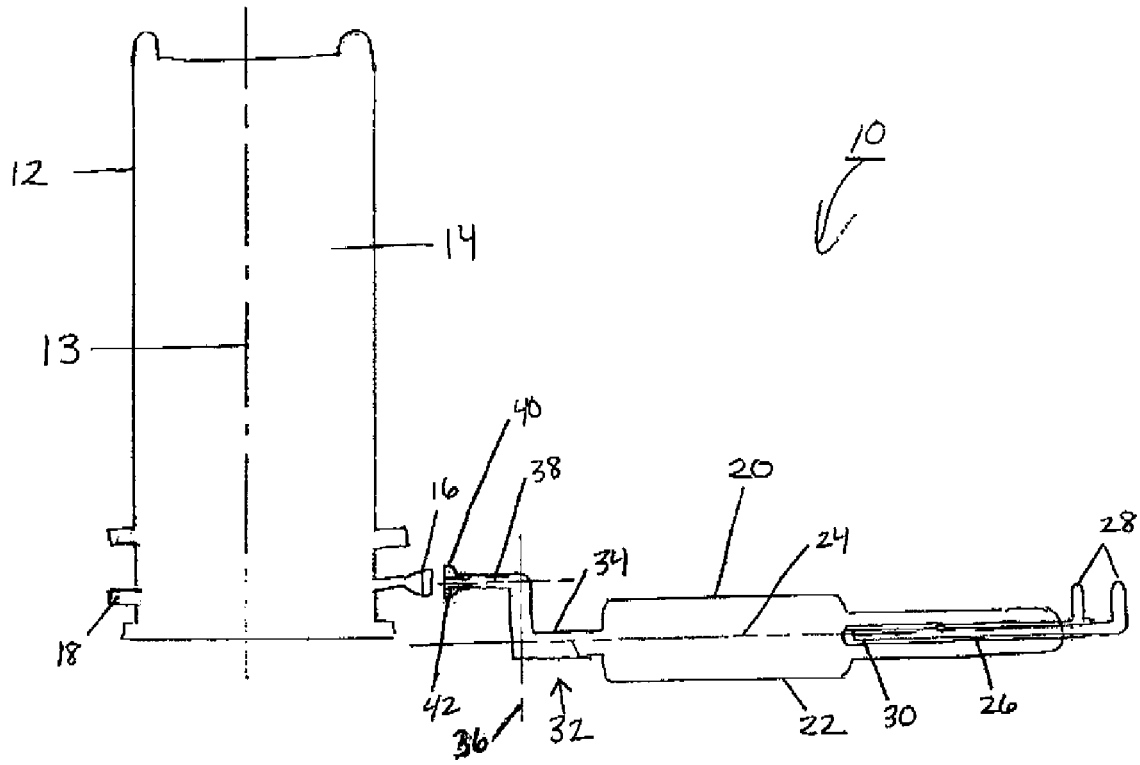
FIG. 1 depicts a gas delivery system according to a preferred embodiment of the present invention.

Referring now to FIG. 1, there is depicted a gas delivery system 10 connected to a reactor 12. The reactor 12 extends along axis 13 and is preferably formed of glass. However, the reactor 12 may be formed of other materials known in the art suitable for the processing of integrated circuits, and compatible with the materials, processes, and environments described herein. In a preferred embodiment, the reactor 12 is cylindrical in shape. The reactor 12 has a reactor chamber 14 in which layers are formed on integrated circuits. The reactor 12 also includes a gas inlet port 16 and a gas exhaust port 18. The gas inlet port 16 preferably comprises a ball fitting. Preferably, the gas inlet port 16 and the gas exhaust port 18 are made of glass.

Figure 2:
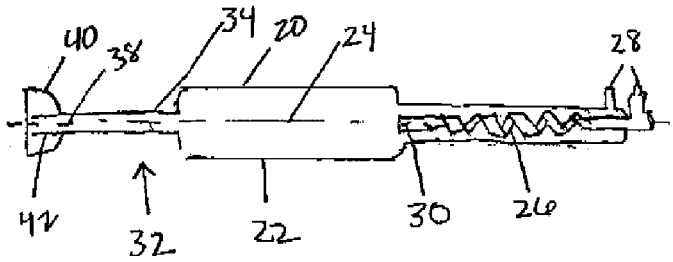
FIG. 2 depicts a gas delivery system according to an alternate embodiment of the present invention.

The gas delivery system 10 includes a torch chamber 20. The torch chamber includes an outer wall 22 extending along a first axis 24. In a preferred embodiment, the outer wall 22 extends circularly along the axis 24 thereby forming a cylinder. A torch injector 26 extends into the torch chamber 20 at a first end of the torch chamber 20. The torch injector 26 preferably comprises two gas intake ports 28 at a first end of the torch injector 26 and a gas injector section 30 at a second end of the torch injector 26. In a preferred embodiment as depicted in FIG. 2, the torch injector 26 preferably receives hydrogen gas and oxygen gas through the gas intake ports 28. It is appreciated that there may be a different number of gas intake ports 28, and that different gases may be used, as described in more detail above.

In a preferred embodiment, the torch injector 26 comprises a substantially straight tubing section extending along the axis 24 as depicted in FIG. 1. In an alternate embodiment, the torch injector 26 comprises a spiral tubing section extending along the axis 24, as depicted in FIG. 2. Alternately, the torch injector 26 extends along an axis substantially parallel to the axis 24. Preferably, the torch injector 26 is made of glass. However, the torch injector 26 may also be formed of other materials known in the art. The torch injector 26 preferably includes a tubing section that extends along the axis 24 between the at least one gas intake port 28 and the gas injector section 30. Once a gas enters the torch injector 26 through the at least one gas intake port 28, the gas passes through the tubing section and is expelled into the torch chamber 20 by the gas injector section 30. Most preferably, the two gas intake ports 28 feed into tubing sections that are substantially coaxial.

As depicted in FIGS. 1 and 2, a gas outlet section 32 preferably extends along the axis 24 at a second end of the torch chamber 20. Alternately, the gas outlet section 32 extends from the second end of the unitized torch chamber along an axis substantially parallel to the axis 24. The gas outlet section 32 preferably includes a first tubing member 34, a gas outlet port 40, and a gas insertion nozzle 42.

The first tubing member 34 may be fashioned in a variety of configurations. Preferably, the first tubing member 34 extends in an axial direction substantially parallel to the axis 24 of the torch chamber 20. Most preferably, the first tubing member 34 is formed in a first ninety degree bend extending in an axial direction substantially perpendicular to the axis 24 of the torch chamber 20. As shown in FIG. 1, the first tubing member 34 is preferably disposed along an axis 36 after formation of the first ninety degree bend. In a preferred embodiment, the first tubing member 34 is also formed in a second ninety degree bend extending in an axial direction substantially parallel to the axis 24 of the torch chamber 20. As depicted in FIG. 1, the first tubing member 34 preferably extends along an axis 38 after the second ninety degree bend and is connected to the gas outlet port 40. In a preferred embodiment, the first tubing member 34 is made of glass.

The gas outlet port 40 preferably comprises a socket fitting. The socket fitting of the gas outlet port 40 is for receiving the ball fitting of the gas inlet port 16. In a particularly preferred embodiment, the 40 and the gas inlet port 16 comprise a ground glass joint utilizing an o-ring seal disposed between the gas inlet port 16 and the gas outlet port 40. In alternate embodiments, other types of complimentary fittings are used for the gas outlet port 40 and the gas inlet port 16.

Figure 3:
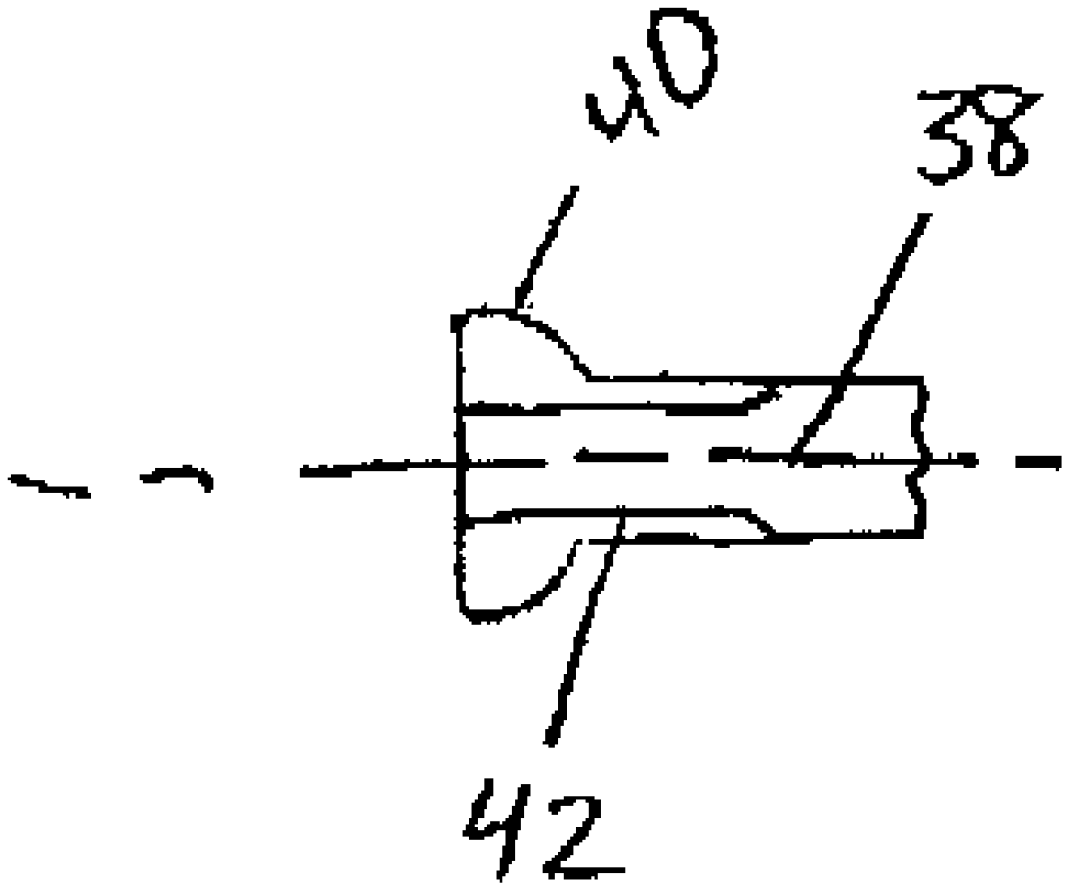
FIG. 3 depicts a gas insertion nozzle according to a preferred embodiment of the present invention.

As shown in detail in FIG. 3, the gas outlet port 40 preferably comprises a gas insertion nozzle 42. The gas insertion nozzle 42 directs a gas flow from the gas outlet section 32 of the gas delivery system 10 into the gas inlet port 16 of the reactor 12. The gas insertion nozzle 42 has a diameter that is smaller than an interior diameter of the gas inlet port 16. The gas insertion nozzle 42 extends coaxially with the gas inlet port 16 from the gas outlet port 40, and the gas insertion nozzle extends to at least an outer surface of the gas inlet port 16. Preferably, the gas insertion nozzle 42 is a unitized structure with the gas outlet port 40. As shown in FIG. 3, the gas insertion nozzle 42 preferably extends to an inner surface of the gas outlet port 40. By extending to the inner surface of the gas outlet port 40, the gas insertion nozzle preferably directs substantially all of the gas flow through the gas outlet port 40 and directly into the gas inlet port 16 thereby minimizing any exposure of the o-ring or other seal to the gas flow.

At least one gas enters the gas delivery system 10 through the at least one gas intake port 28 of the torch injector 26. Preferably, hydrogen gas and oxygen gas enter the gas delivery system 10 through two gas intake ports 28, as depicted in FIG. 2. In a preferred embodiment, the hydrogen gas and the oxygen gas form a gas stream through the gas delivery system 10. Preferably, the gas stream flows through the tubing section of the torch injector 26 and is expelled into the torch chamber 20 by the gas injector section 30. The gas stream exits the torch chamber 20 through the gas outlet section 32.

The gas stream flows through the first tubing member 34 of the gas outlet section 32 and through the gas outlet port 40. The gas outlet port 40 engages with the gas inlet port 16 of the reactor 12. Preferably, the gas stream is directed through the gas outlet port 40 and directly into the gas inlet port 16 by the gas insertion nozzle 42. By directing the gas flow directly into the gas inlet port 16, the interaction between the gas stream and seal materials of the connection, such as an o-ring disposed between the gas inlet port 16 and the gas outlet port 40, is preferably reduced. By reducing the exposure of the o-ring to the gas stream, the o-ring is protected from possible degradation thereby reducing possible contamination of the gas delivery system 10.

The gas stream enters the reactor chamber 14 through the gas inlet port 16 from the gas outlet port 40. Within the reactor chamber 14, the integrated circuit processing preferably occurs. The gas stream exits the reactor chamber 12 through the gas exhaust port 18.

As shown in FIG. 1, the gas delivery system 10 has only one external connection at the junction of the gas outlet port 40 and the gas inlet port 16. Use of the unitized gas delivery system 10, including the torch chamber 20, torch injector 26, and integrated gas outlet section 32 allows the gas delivery system 10 to require only one external connection. By reducing the number of external connections, the possibility of external contaminants or impurities entering the gas delivery system 10 is reduced. Additionally, the gas insertion nozzle 42 reduces degradation of the connection materials by directing the gas stream directly into the gas inlet port 16 and reducing interaction between the gas stream and connection materials such as o-rings.

Since an external connection in a gas delivery system is subject to degradation, the external connection point is a potential inlet for ambient atmospheric leaks and contamination. By having only one external connection, the gas delivery system 10 reduces the potential inlets for contamination, allowing for a cleaner and more contamination free environment in which to process integrated circuits.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A gas delivery system for delivering a gas to a reactor having a reactor chamber, a gas inlet port, and a gas exhaust port, the gas delivery system comprising:

a torch chamber having an outer wall extending along a first axis, a torch injector extending into the torch chamber at a first end of the torch chamber, the torch injector including at least two gas intake ports for receiving at least two gases where the two gas intake ports feed into two substantially coaxial tubes that are part of a gas injector section for expelling the at least two gases into the torch chamber, and a gas outlet section at a second end of the torch chamber, the gas outlet section including a first tubing member disposed along a second axis and a gas outlet port connected to the first tubing member, the gas outlet port of the gas outlet section for engaging the gas inlet port of the reactor, where the torch chamber, the torch injector, and the gas outlet section of the gas delivery system are formed into a unitized structure with no resealable connections between them.

2. The system of claim 1 wherein the gas outlet port is a socket fitting and the gas inlet port is a ball fitting and the gas outlet port further comprises a gas insertion nozzle for directing a gas flow from the gas outlet section of the unitized gas delivery system into the gas inlet port of the reactor, the gas insertion nozzle having a diameter that is smaller than an interior diameter of the gas inlet port, the gas insertion nozzle extending coaxially with the gas inlet port from the gas outlet port, and the gas insertion nozzle extending at least to an outer surface of the gas inlet port.

3. The system of claim 2 wherein the gas insertion nozzle is a unitized structure with the gas outlet port.

4. The system of claim 1 wherein the gas intake ports are for receiving hydrogen gas and oxygen gas.

5. The system of claim 1 wherein the gas inlet port and the gas outlet port comprise a ground glass joint.

6. The system of claim 1 wherein the gas inlet port and the gas outlet port further comprise an o-ring seal disposed between the gas inlet port and the gas outlet port.

7. The system of claim 1 wherein the gas delivery system is made of glass.

8. The system of claim 1 wherein the second axis of the first tubing member is substantially parallel to the first axis of the torch chamber, the first tubing member is formed in a first ninety degree bend extending in an axial direction substantially perpendicular to the first axis and the second axis, and the first tubing member is also formed in a second ninety degree bend extending in an axial direction substantially parallel to the first axis and the second axis.

9. The system of claim 1 wherein the torch injector comprises a substantially straight tubing section extending along an axis that is substantially parallel to the first axis of the torch chamber.

10. The system of claim 1 wherein the torch injector comprises a spiral tubing section extending along an axis that is substantially parallel to the first axis of the torch chamber.

11. A gas delivery system for delivering a gas to a reactor, the gas delivery system comprising:

a torch chamber having an outer wall extending along a first axis, a torch injector extending into the torch chamber at a first end of the torch chamber, the torch injector including at least two gas intake ports for receiving at least two gases, where the two gas intake ports feed into two substantially coaxial tubes that are part of a gas injector section for expelling the at least two gases into the torch chamber, and a gas outlet section at a second end of the torch chamber, the gas outlet section including a first tubing member disposed along a second axis and a gas outlet port connected to the first tubing member, where the torch chamber, the torch injector, and the gas outlet section of the gas delivery system are formed into a unitized structure with no resealable connections between them.

12. The system of claim 11 wherein the reactor comprises a reactor chamber, a gas inlet port for engaging the gas outlet port of the gas outlet section of the unitized gas delivery system, and a gas exhaust port.

13. The system of claim 12 wherein the gas outlet port is a socket fitting and the gas inlet port is a ball fitting and the gas outlet port further comprises a gas insertion nozzle for directing a gas flow from the gas outlet section of the unitized gas delivery system into the gas inlet port of the reactor, the gas insertion nozzle having a diameter that is smaller than an interior diameter of the gas inlet port, the gas insertion nozzle extending coaxially with the gas inlet port from the gas outlet port, and the gas insertion nozzle extending at least to an outer surface of the gas inlet port.

14. The system of claim 12 wherein the gas outlet port and the gas inlet port further comprise a ground glass joint with an o-ring seal disposed between the gas inlet port and the gas outlet port.

15. The system of claim 13 wherein the gas insertion nozzle is a unitized structure with the gas outlet port.

16. A gas delivery system for delivering a gas to a reactor, the gas delivery system comprising:

a torch chamber having an outer wall extending along a first axis, a torch injector extending into the torch chamber at a first end of the torch chamber, the torch injector including at least two gas intake ports for receiving at least two gases, where the two gas intake ports feed into two substantially coaxial tubes that are part of a gas injector section for expelling the at least two gases into the torch chamber, a gas outlet section at a second end of the torch chamber, the gas outlet section including a first tubing member disposed along a second axis and a gas outlet port connected to the first tubing member, the reactor having a reactor chamber, a gas inlet port for engaging the gas outlet port of the gas outlet section of the gas delivery system, and a gas exhaust port, and a gas insertion nozzle connected to the gas outlet port for directing a gas flow from the gas outlet section of the unitized gas delivery system into the gas inlet port of the reactor, the gas insertion nozzle having a diameter that is smaller than an interior diameter of the gas inlet port, the gas insertion nozzle extending coaxially with the gas inlet port from the gas outlet port, and the gas insertion nozzle extending at least to an outer surface of the gas inlet port.

17. The system of claim 16 wherein the gas outlet port and the gas inlet port comprise a ground glass joint.

18. The system of claim 17 wherein the gas outlet port and the gas inlet port further comprise an o-ring seal disposed between the gas inlet port and the gas outlet port.

19. The system of claim 16 wherein the gas insertion nozzle is a united structure with the gas outlet port.

* * * * *